US010213796B2

(12) United States Patent
Frey

(10) Patent No.: US 10,213,796 B2
(45) Date of Patent: Feb. 26, 2019

(54) FLUID DISCHARGING SYSTEM

(75) Inventor: Daniel Frey, Duesseldorf (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 605 days.

(21) Appl. No.: 14/348,010

(22) PCT Filed: Mar. 30, 2012

(86) PCT No.: PCT/EP2012/055747

§ 371 (c)(1),
(2), (4) Date: May 2, 2016

(87) PCT Pub. No.: WO2013/045121

PCT Pub. Date: Apr. 4, 2013

(65) Prior Publication Data

US 2018/0036750 A1 Feb. 8, 2018

(30) Foreign Application Priority Data

Sep. 28, 2011 (DE) ..... 10 2011 083 579

(51) Int. Cl.
*F04B 7/06* (2006.01)
*B05B 3/02* (2006.01)
(Continued)

(52) U.S. Cl.
CPC ..... *B05B 3/021* (2013.01); *F04B 7/06* (2013.01); *F04B 19/006* (2013.01);
(Continued)

(58) Field of Classification Search
CPC ..... F04B 19/00; F04B 19/006; F04B 7/04; F04B 7/06; F02M 61/1813; E03D 9/005; B05B 3/021
(Continued)

(56) References Cited

U.S. PATENT DOCUMENTS 6,179,596 B1 1/2001 Weisener et al.
6,558,127 B2 * 5/2003 Maruyama ..... F04B 7/06 222/333
(Continued)

FOREIGN PATENT DOCUMENTS

DE 102006012080 A1 9/2007
EP 0795292 A2 9/1997
(Continued)

OTHER PUBLICATIONS

International Search Report for PCT/EP2012/055747 dated Jul. 6, 2012.

*Primary Examiner* — Alexander M Valvis
(74) *Attorney, Agent, or Firm* — Lorenz & Kopf, LLP

(57) ABSTRACT

A fluid discharging system having a pump and a discharging spray head having at least one nozzle through which fluid to be discharged exits is provided. The pump has a stator and a rotor which is attached in a chamber of the stator and can be rotated in relation to the stator about a rotational axis and axially along the axis. The axial displacement of the rotor in a first axial direction is configured such that it brings about pump filling operation. A fluid is drawn via an inlet into the stator chamber, and the axial displacement in an opposite second axial direction is configured such that it brings about discharging operation. The fluid in the chamber is expelled out of an outlet of the pump. The outlet of the pump is arranged in the rotor, and the discharging spray head is fluidically connected to the outlet of the pump.

16 Claims, 3 Drawing Sheets

(51) Int. Cl.

| | |
|---|---|
| ***F04B 19/00*** | (2006.01) |
| *A47L 15/42* | (2006.01) |
| *A47L 15/44* | (2006.01) |
| *D06F 39/02* | (2006.01) |
| *E03D 9/00* | (2006.01) |

(52) U.S. Cl.
CPC ..... *A47L 15/4282* (2013.01); *A47L 15/4418* (2013.01); *D06F 39/024* (2013.01); *E03D 9/005* (2013.01)

(58) Field of Classification Search
USPC ..... 239/380; 417/415, 443, 461, 490, 492, 417/498, 500, 509
See application file for complete search history.

(56) References Cited

U.S. PATENT DOCUMENTS

| | | | | |
|---|---|---|---|---|
| 6,758,407 | B1 * | 7/2004 | Lambert | F02M 45/086 123/294 |
| 2009/0123309 | A1 * | 5/2009 | Hilber | A61M 5/14244 417/417 |

FOREIGN PATENT DOCUMENTS

| | | | |
|---|---|---|---|
| EP | 0856666 | A1 | 8/1998 |
| EP | 1132615 | A2 | 9/2001 |
| WO | 2007074363 | A2 | 7/2007 |

* cited by examiner

FLUID DISCHARGING SYSTEM

CROSS REFERENCE TO RELATED APPLICATION

This application claims priority to International Patent Application No. PCT/EP2012/055747 filed Mar. 30, 2012, which was published under PCT Article 21(2) and which claims priority to German Patent Application No. 10 2011 083 579.2 filed Sep. 28, 2011, both of which are hereby incorporated by reference in their entirety.

TECHNICAL FIELD

The technical field relates to a system for discharging fluids, in particular liquids, in the form of a spray.

BACKGROUND

There are many applications in which liquids need to be sprayed; the desired spray configuration depends on the application and can include parameters such as the flow rate and quantity of liquid to be discharge, droplet size, fluid stream diameter, outflow speed of the fluid, and the spatial distribution of liquid. In addition to the properties of the liquid (e.g. viscosity) and pressure, the spray configuration depends inter alia on the nozzle geometry, which in conventional systems is static and sometimes comprises an adjustable gap or an adjustable emergence shape in order to vary the spray configuration. Conventional discharging systems do not, however, offer good, precisely controlled, wide spatial distribution of fluids, in particular in a context of precise metering.

At least one object herein is to describe a discharging system that enables well-controlled and uniform spatial delivery of fluid with the lowest possible noise emission and/or low energy consumption and/or low wear.

For some applications it is advantageous to furnish a fluid discharging system that can discharge a fluid radially outward with precise regulation.

For some applications it is advantageous to furnish a fluid discharging system that can discharge small quantities of a fluid with precise regulation.

For some applications it is advantageous to furnish a fluid discharging system that can discharge a fluid at a constant discharge rate.

For some applications it is advantageous to furnish a fluid discharging system that can be integrated separately into a container and permits a wide range of configurations of the container embodiment.

It is advantageous to furnish a fluid discharging system that is compact and cost-effective.

It is advantageous to furnish a fluid discharging system that is easy to operate.

The objects of this invention are achieved by providing a discharging system according to Claim 1. Furthermore, other desirable features and characteristics of the present invention will become apparent from the subsequent detailed description of the invention and the appended claims, taken in conjunction with the accompanying drawings and this background of the invention.

SUMMARY

What is disclosed here is a fluid discharging system that comprises a pump and a discharge spray head that comprises at least one nozzle through which the fluid to be discharged emerges. The pump comprises a stator and a rotor that is mounted in a chamber of the stator and is rotatable with respect to the stator around a rotation axis and is axially displaceable along said axis, wherein the axial displacement of the rotor in a first axial direction is configured so that it brings about a pump filling mode in which the fluid is drawn through an inlet into the stator chamber, and in an opposite, second axial direction is configured so that it brings about a discharge mode in which the fluid in the chamber is expelled from an outlet of the pump. The outlet of the pump is arranged in the rotor and the discharge spray head is connected fluidically to the outlet of the pump and is arranged on or close to an axial outlet end of the rotor, wherein the discharge spray head is configured so that it discharges the fluid at least in part in a radial direction and surrounding the rotation axis.

Fluids to be discharged can be liquids, gases, mixtures of gas and liquid, gels, and other flowable substances. The fluid discharging system according to the embodiments of the invention is particularly suitable for spraying liquids.

In an advantageous embodiment, the rotor comprises first and second axial extensions of different diameters that are mounted in corresponding first and second chamber segments of the stator chamber, and first and second seals that are mounted in the stator housing and surround the first and the second axial rotor extension, wherein the rotor extensions comprise fluid delivery conduits that, in combination with the respective sealing rings, serve as valves that open and close a connection respectively between the inlet of the pump and the chamber segments, or between the chamber segments and the outlet of the pump, as a function of the angular displacement of the pump rotor.

In an advantageous embodiment, the outlet of the pump is arranged in a second axial rotor extension, and the second axial rotor extension has a diameter that is smaller than the diameter of the first axial rotor extension. The outlet of the pump can advantageously emerge from the axial emergence end of the rotor.

In an advantageous embodiment, the discharge spray head is mounted immovably at the axial emergence end of the rotor, or extends therefrom and rotates together with the rotor.

The discharge spray head can be present in the form of a separate component that is mounted at the axial emergence end of the rotor; it is also possible to constitute a spray head in one piece with the rotor as a single component.

The discharge spray head can have a diameter that is greater than the diameter of the axial emergence end of the rotor, or it can have a diameter that is smaller than or equal to the diameter of the axial emergence end of the rotor.

The discharge spray head can advantageously comprise a plurality of nozzles, the nozzles being oriented at one or more angles ($\alpha$) with respect to the radial direction. The projection direction of the nozzles can assume a selected angle, for example in a range in which $-80° < \alpha < +90°$, or less, for example in which $-60° < \alpha < +90°$. The angular rotational position of the pump ejection range, which can be located preferably in a range from about 60° to about 120°, for example about 90° or approximately about 90° C., depends on the pump configuration and is determined thereby, and allows selection of where pump ejection begins and where it ends, and thus of the beginning and ending angles, which constitutes the angular distribution of the spray around the rotation axis. The configuration of the pump valve is determined by the position of the liquid delivery conduits, the shape and position of the seals, and the axial displacement characteristic of the rotor as a function of rotation. It is thereby possible, by configuring the combination of parameters, to generate a broad range of asymmetrical or symmetrical spray patterns, said parameters including: fluid throughput, angular direction α of each nozzle relative to the radial direction R, opening angle of each nozzle element, number and spatial distribution of the nozzles, and configuration of the pump valve that determines the rotation angle of the fluid ejection mode. It is thereby possible, for example, to have more fluid in a specific spray region that is located relatively far away from the apparatus and to have less fluid in a relatively close-in spray region, and/or to have fluid at a different angle, for example laterally adjacent to or behind the discharging system.

The plurality of nozzles can each be oriented at the same angle with respect to the radial direction, or they can be oriented at two or more different angles.

In advantageous embodiments, the axial rotor emergence end extends outside the stator.

In another embodiment the discharging system can comprise a discharge spray head that is mounted fixedly and permanently on an end wall of a housing of the stator, adjacently to the emergence end of the rotor that is arranged inside the housing.

The discharge spray head can comprise a flexible cap having a circumferential lip that is preloaded with respect to the end wall of the stator housing and is displaceable and/or deformable under the fluid pressure in order to demarcate, with the end wall of the stator housing, a spray nozzle, for example an annular spray nozzle.

The rotor and the stator can advantageously comprise complementary cam mechanisms that bring about the axial displacement of the rotor in both opposite axial directions as a function of an angular displacement of the rotor.

BRIEF DESCRIPTION OF THE DRAWINGS

Further objects and advantageous features of the invention are evident from the claims, from the detailed description, and from the appended drawings, in which:

FIGS. 1A and 1B are cross-sectional views through a fluid discharging system according to a first embodiment of the invention, wherein FIG. 1A illustrates an end of an ejection position of a pump cycle and FIG. 1B illustrates an end of a filling position of the pump cycle;

DETAILED DESCRIPTION

Figure 1A:
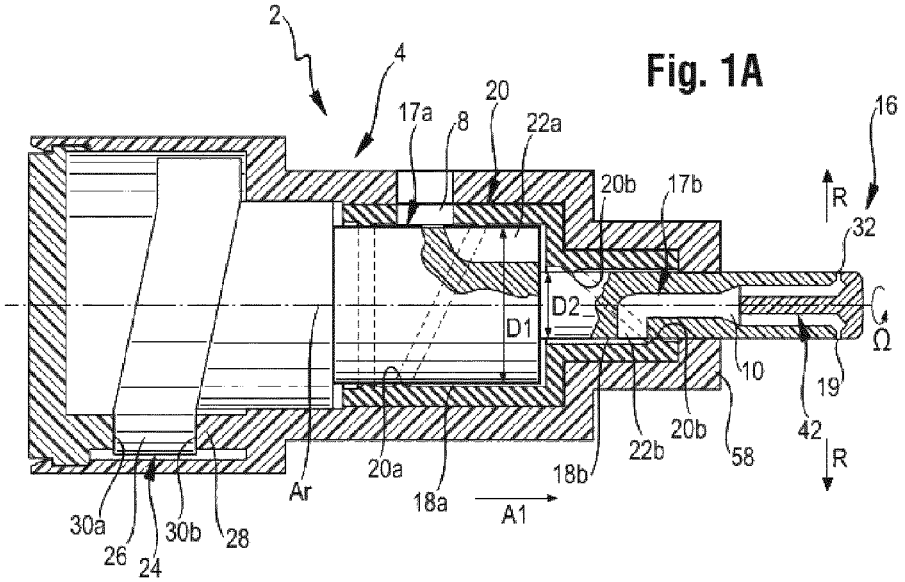

The following detailed description is merely exemplary in nature and is not intended to limit the invention or the application and uses of the invention. Furthermore, there is no intention to be bound by any theory presented in the preceding background or the following detailed description.

Referring to the Figures, a discharging system 2 according to various embodiments of the invention comprises a discharge pump 4 and a discharge spray head 16, 26, 36, 46, 56 that is mounted on an outlet of the pump. The pump comprises an inlet 8 in communication with the interior of a container (not shown) that comprises a fluid to be discharged or is connected to a tube or another line that in turn is connected to a source or to a connector for fluid, for example a liquid, to be discharged.

Discharge pump 4 can advantageously have a configuration and a pump mode that are similar to the pump described in WO 2007/074363, except for the differences described here. Pump 4 comprises a stator 14 and a rotor 12 mounted rotatably in the stator. Stator 14 comprises a housing 34 and a seal/valve system 20 that demarcates a chamber 18*a*, 18*b* that will be referred to hereinafter as a "pump chamber," within which first and second axial rotor extensions 17*a*, 17*b* are mounted. Valve/seal system 20 comprises a first and a second seal 20*a*, 20*b* that are mounted in stator housing 14 and demarcate sealing rings that sealingly surround the first and the second axial rotor extension 17*a* and 17*b*, respectively. Fluid delivery conduits 22*a*, 22*b* are provided in the first and the second axial rotor extension. First axial rotor extension 17*a* has a generally cylindrical shape with a diameter D1 that is greater than diameter D2 of the second axial extension 18, which also has a generally cylindrical shape. The axial extensions having fluid delivery conduits 20*a*, 20*b* interact with the respective first and second seal to form a first and a second valve that open and close the fluid connection via the respective seal as a function of the angular and axial displacement of the rotor.

Second fluid delivery conduit 20*b* in second axial rotor extension 17*b* having a smaller diameter than first axial rotor extension 17*a* also forms outlet 10 of pump 4 and leads into discharge head 16, 26, 36, 46, 56. In the embodiments shown, the second fluid delivery conduit comprises a conduit that is recessed into the rotor and extends from outlet 10 to an opening 40 on the surface of second axial extension 17*b*. Opening 40 is configured so that it passes by second seal 20*b* upon rotation of the rotor, so that during that portion of the fluid discharge cycle it respective enters pump chamber 18*b* and leaves chamber 18*b* in order to close off the outlet during the portion of the filling cycle of the pump chamber. The recessed outlet conduit 10 can extend to an axial end of the rotor as illustrated in the various embodiments shown, or it can depart from the rotor radially before it reaches the axial end of the rotor.

First fluid delivery conduit 20*a* can be present in the form of a groove or an open conduit in the surface of the rotor, or can be recessed below the rotor surface, openings that lead onto the rotor surface being cut out.

In the embodiments illustrated, second axial rotor extension 17*b* extends through main housing segment 34 of stator outside the stator, so that it is accessible from outside the stator.

Figure 5:
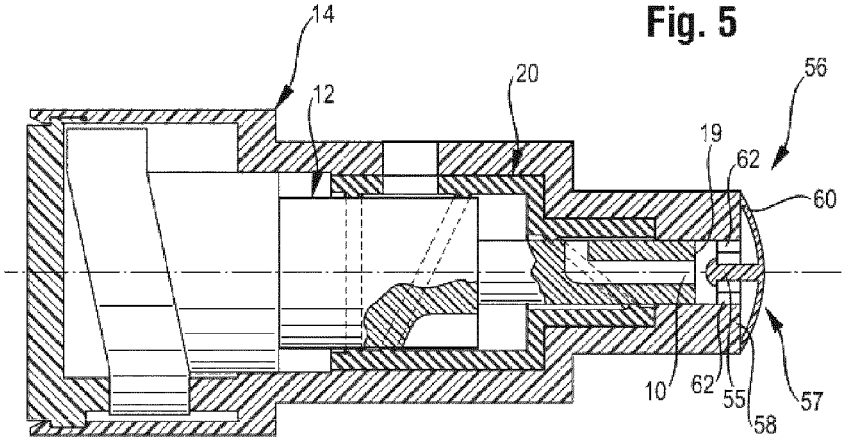
FIG. 5 is a schematic cross-sectional view through a discharge head according to a fifth embodiment of the invention.

In a variant such as the one illustrated, for example, in FIG. 5, however, the second axial rotor extension can be contained within the stator housing, i.e. it does not extend out of the stator housing, and the discharge head in communication with pump outlet 10 is arranged at least in part outside the stator housing. In a variant (not shown) in which the second axial rotor extension is contained inside the stator housing and the discharge head is mounted at an outlet end 19 of the rotor, the discharge head can extend into the stator housing in order to be fastened on the second axial rotor extension.

In embodiments illustrated in FIGS. 1A to 1C, 2, 3, and 4, discharge spray head 16, 26, 36, 46 is advantageously mounted at outlet end 19 of the rotor and thus rotates together with the rotor. The discharge spray head comprises one or more nozzles 32 that are directed at least in part radially outward and are configured so that they spray the fluid radially outward around rotation axis Ar. Each nozzle can be directed at any desired angle α with respect to a plane orthogonal to axis Ar, specifically from −90° to +90°, preferably in the range from about −80° to about +80°, depending on the desired distribution of the spray, from a narrow cone directed forward (in direction A1) through a spray radially ejected in direction (R) to a spray directed backward (in direction A2). In variants having a plurality of nozzles 32, 32', the nozzles can be oriented at an identical angle with respect to axis Ar or at different angles, in order to generate various spray cones. A wide range of liquid spray configurations can thus be generated. The combined action of the spray nozzles during operation can be configured in order to generate one or more spray cones up to 360° around axis Ar, or partial spray cones that, for example, cover less than 180° around the axis, for example 90° or less per nozzle. The fluid discharging system according to the invention can thus generate a spray geometry that combines both the selection of an emergence angle α with respect to radial direction R and a desired distribution angle around axis Ar that can be equal to less than 180° and even less than 90°, depending on the pump sealing and the configuration of the fluid conduit, which determines the rotation angle Ω at which the pump ejects liquid.

The nozzles can have various dimensions and opening shapes, which are configured so that they generate a fine or less-fine fluid stream having a desired cross-sectional profile, such as cylindrical or rectangular. The diameter D3 of the spray head can also have various dimensions in order to make available nozzles 32 that emerge close to rotation axis Ar as in the embodiments of FIGS. 1A to 1C and 4, the spray head diameter being substantially equal to (or smaller than) diameter D2 of the second axial rotor extension, or that emerge farther away from the axis, as shown in FIGS. 2 and 3, spray head diameter D3 being greater than diameter D2 of the second axial rotor extension.

Figure 1B:
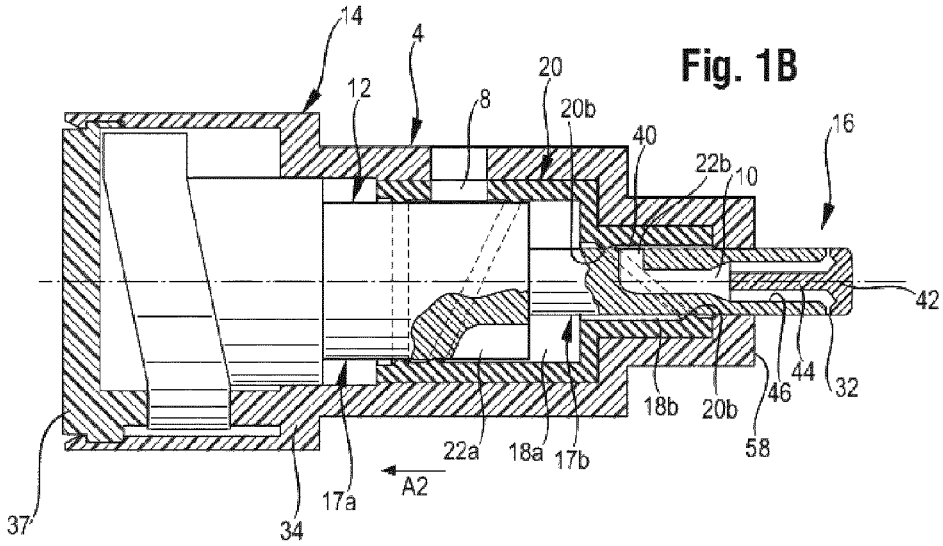
Figure 1C:
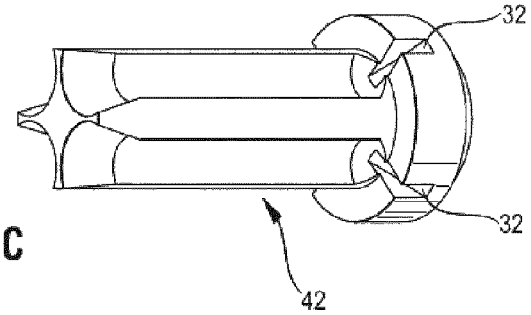
FIG. 1C is an enlarged perspective view of a discharge head insert of the discharging system of FIGS. 1A and 1B.

In the embodiment of FIGS. 1A to 1C, discharge spray head 16 comprises an insert 42 that is fastened at outlet end 19 of the rotor and comprises a core segment 44 that extends into an outlet cavity 46 of the rotor which is configured so that it directs fluid to each of nozzles 32. With this embodiment it is also possible to provide, instead of the individual nozzles 32, a variant in which there is a single annular nozzle that completely surrounds the spray head. The insert can be produced from an injection-molded plastic or from another material, and can be joined to the rotor by mechanical means (e.g. locking projections), or welded or fastened thereto.

Figure 2:
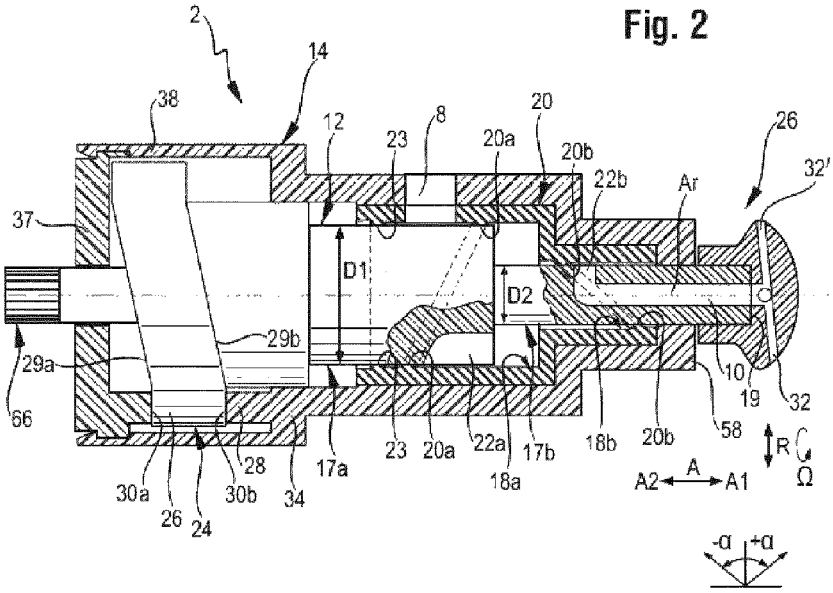
FIG. 2 is a schematic cross-sectional view through a discharge head according to a second embodiment of the invention.
Figure 3:
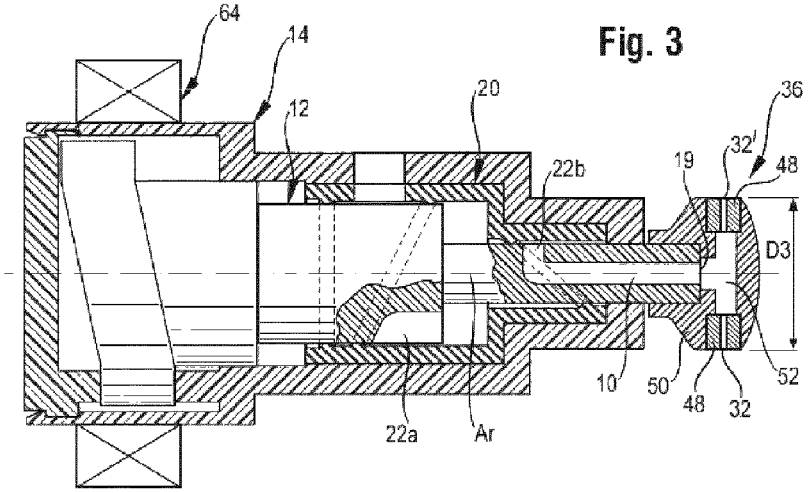
FIG. 3 is a schematic cross-sectional view through a discharge head according to a third embodiment of the invention.

In the embodiment of FIGS. 2 and 3, discharge spray head 26 is a separate component that is mounted via outlet end 19 of the rotor, and it can be produced from an injection-molded plastic or another material and joined to the rotor via mechanical means (e.g. locking projections), or welded or fastened thereto. In the variant of FIG. 2 there are a plurality of nozzles 32, 32' that are oriented at various angles α, while the nozzles in the variant of FIG. 3 are oriented at the same angle, in the example illustrated at an angle of 90°, with respect to axis Ar. In the latter embodiment the nozzles are constituted from a different material than the body, and/or nozzles that are very fine as compared with the dimensions of fluid flow conduit 52 can be formed inside spray head 36.

Figure 4:
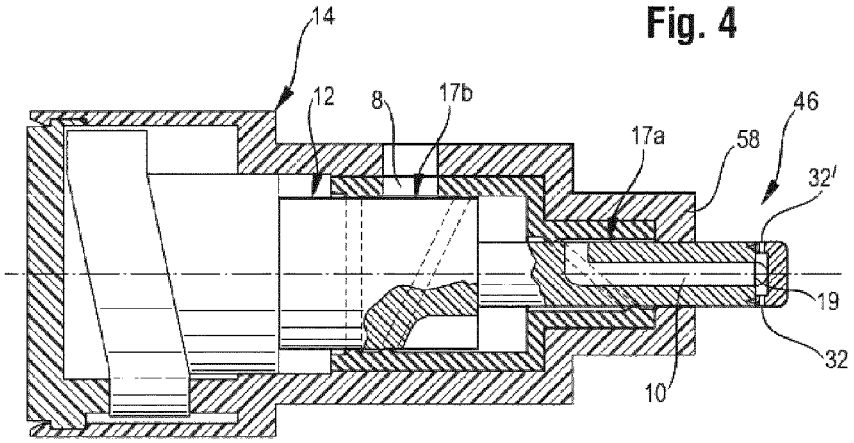
FIG. 4 is a schematic cross-sectional view through a discharge head according to a fourth embodiment of the invention.

In the embodiment of FIG. 4, spray head 46 has a cap segment 42' that is fastened on outlet end 19 of the rotor and has substantially the same diameter as the rotor end, as well as nozzles 32, 32' that are constituted directly in cap segment 42'.

In the embodiment of FIG. 5, discharge spray head 56 is not mounted on the rotor but instead is constituted on the stator housing, rotor outlet end 19 being arranged inside the housing. The discharge spray head comprises an elastic or flexible cap 57, made for example of an elastomer, that is fastened via an end wall 58 of the stator housing and comprises a flexible lip 60 that presses circumferentially against end wall 58. One or more outlet openings traverse end wall 58 so that the fluid can be pumped out through end wall 58 and can be deflected radially by the flexible cap, with the result that the flexible lip lifts off from the end wall under the pressure of the pumped fluid in order to define the spray nozzle gap. Cap 57 can comprise a central fastening bolt 55 in order to fasten the cap on the stator housing, which is equipped with a complementary through hole.

In a preferred embodiment, the axial motion (A) of rotor 12 is advantageously brought about by a double-cam mechanism 24 that defines the axial displacement of the rotor in both axial directions, namely in pump function direction A1 and in pumping filling direction A2, specifically as a function of angular displacement Ω of the rotor. Cam mechanism 24 comprises a rotor cam 26 and a stator cam 28. The stator cam can be present in the form of one or more projections 30*a*, 30*b*, and the rotor cam can be present in the form of annular cam surfaces 29*a*, 29*b*. In the embodiment illustrated, a first cam surface 29*a* of the rotor interacts with a first stator cam projection 30*a* in order to define the pump discharge function (i.e. ejection of fluid from the pump), and an opposite second cam surface 29*b* of the rotor interacts with a second stator cam projection 30*b* in order to define the pump filling function (i.e. drawing fluid into the pump). The stator cam projection can also be present in the form of a projection that protrudes inward from a side wall of the stator in a radial direction R and is received in a circumferential groove of the rotor. The cam mechanism can be reversed by the fact that the stator provides the annular cam surfaces, and the rotor provides first and second cam projections on each side of the annular stator cam.

The above-described double cam mechanism is advantageous in that the cam elements can be manufactured from injection-molded plastic or other materials and can be assembled, or formed in one piece, with the rotor or the stator of the pump, all this in a very cost-effective configuration. The double cam mechanism, in combination with a pump according to this invention, is also advantageous in that pumping can occur in both directions; this can be utilized in order to prevent liquid from dripping from the spray head after the pump is switched off, by drawing in fluid from the nozzle.

In the embodiment illustrated, stator housing 14 can comprise a main housing segment 34 that surrounds the rotor chamber, and a cap segment 37 in order to lock the rotor in the main housing. Cap segment 37 can advantageously also be produced from an injection-molded plastic, but for a cost-effective configuration it can also be produced from a stamped and shaped metal sheet and can be fastened on the main housing segment via elastic tongues 38 or other mechanical fastening means that enable rapid installation of the cap segment on the main housing segment without additional fastening means. The cap segment can also be fastened on the main housing segment by joining or welding (e.g. ultrasonic welding). Seal/valve system 20 can advantageously be produced from an elastomeric material that is shaped, as a single element, by injection molding into the main housing segment of the stator. For very inexpensive assembly, the components of the discharging system can advantageously be assembled, in principle or only, by inserting the components in an axial direction A. The rotor can advantageously be constructed by axial insertion into the main housing segment of the stator and into seal/valve system 20, followed by pressing the cap segment over the open end of the main body segment until tongues 38 are clipped and locked onto the cap segment, and by inserting and mounting the discharge spray head onto outlet end 19 of the rotor.

The rotor can be rotationally driven by an electrical drive system that, for example, comprises electromagnets 64 in the stator (see FIG. 3) which surround a drive segment of the rotor which is equipped with permanent magnets. The rotor can also be driven by a mechanical or electrical drive system mechanically coupled to the rotor, for example via a drive pinion 66 (see FIG. 2) that extends from the rotor at an end of the discharging system that is located remotely from the spray head.

The invention can advantageously be used to generate radially or conically distributed sprays of fluid, such as liquids.

Surfactants

The fluid comprises at least one surfactant, preferably at a concentration from about 0.1 to about 30 wt %, particularly preferably between about 0.5 and about 20 wt %, very particularly preferably between about 1 and about 15 wt %. It has been found that the use of a surfactant-containing fluid has several positive effects in connection with the pump according to the present invention. Firstly, an appreciable decrease in noise emission from the pump can be observed. Reduced friction of the moving pump parts can also be observed, resulting in lower energy consumption upon operation of the pump, and decreased wear.

Particularly preferred in this regard according to the present invention are anionic surfactants such as (linear) alkylbenzenesulfonates, fatty alcohol sulfates, or alkanesulfonates, etc., preferably in quantities, for example, from about 0.1 to about 30 wt %, and/or nonionic surfactants, for example alkylpolyglycol ethers, alkylpolyglucosides, or amine oxides, etc., preferably in quantities, for example, from about 0.1 to about 30 wt %, based in each case on the total agent.

The fluid can also contain cationic surfactants, e.g. in quantities from about about 0.01 wt % or about 0.05 wt % to about 30 wt %. According to a preferred embodiment, however, the fluid is free of cationic surfactant, which means here that the fluid contains less than about 10 wt %, preferably less than about 5 wt %, advantageously less than about 3 wt %, with advantage less than about 1 wt %, even more advantageously less than about 0.5 wt %, in particular 0 wt % cationic surfactant.

It is moreover very particularly preferred to configure the pump, the discharge spray head, and the fluid in such a way that a foam is formed upon spraying of the fluid out of the discharge spray head. One skilled in the art will configure this by an appropriate selection of the surfactant concentration in the fluid, and the embodiment of the discharge spray head and the pump pressure.

Viscosity

It is furthermore advantageous that the viscosity of the fluid is between about 1 mPas and about 5000 mPas, preferably between about 10 and about 1000 mPas, at a shear rate of about 30 $s^{-1}$ and a temperature of about 25° C. The viscosity of the fluid can be measured with usual standard methods (for example, Brookfield RVD-VII viscometer at 20 rpm and 20° C., spindle 3).

In further advantageous embodiments of the invention, the fluid can comprise further constituents that are set forth below.

Perfume

The fluid can preferably contain one or more scents, preferably in a quantity from about 0.01 to about 15 wt %, in particular about 0.05 to about 10 wt %, particularly preferably about 0.1 to about 8 wt %. d-Limonene can be contained as a perfume component. In a particularly preferred embodiment the composition contains a perfume made up of essential oils. Usable as such for purposes of this invention are, for example, pine, citrus, jasmine, patchouli, rose, or ylang-ylang oil. Also suitable are muscatel sage oil, chamomile oil, lavender oil, clove oil, lemon balm oil, mint oil, cinnamon leaf oil, linden blossom oil, juniper berry oil, vetiver oil, olibanum oil, galbanum oil, and labdanum oil, as well as orange blossom oil, neroli oil, orange peel oil, and sandalwood oil.

Adherent fragrances that are advantageously usable in the perfume oils in the context of the present invention are, for example, the essential oils such as angelica oil, anise oil, arnica flower oil, basil oil, bay oil, champaca flower oil, silver fir oil, silver fir cone oil, elemi oil, eucalyptus oil, fennel oil, fir needle oil, galbanum oil, geranium oil, gingergrass oil, guaiac wood oil, balsam gurjun oil, helichrysum oil, ho oil, ginger oil, iris oil, cajeput oil, calamus oil, chamomile oil, camphor oil, kanaga oil, cardamom oil, cassia oil, pine needle oil, balsam copaiva oil, coriander oil, spearmint oil, caraway oil, cumin oil, lemon grass oil, ambrette seed oil, myrrh oil, clove oil, neroli oil, niaouli oil, olibanum oil, orange oil, palmarosa oil, patchouli oil, balsam peru oil, petitgrain oil, pepper oil, peppermint oil, pimento oil, pine oil, rose oil, rosemary oil, sandalwood oil, celery oil, star anise oil, thuja oil, thyme oil, verbena oil, vetiver oil, juniper berry oil, wormwood oil, wintergreen oil, ylang-ylang oil, hyssop oil, cinnamon oil, cinnamon leaf oil, and cypress oil.

The higher-boiling or solid fragrances of natural or synthetic origin can, however, also be used advantageously in the perfume oils in the context of the present invention as adherent fragrances or fragrance mixtures. Included among these compounds are the compounds recited below as well as mixtures thereof: ambrettolide, α-amylcinnamaldehyde, anethole, anisealdehyde, anise alcohol, anisole, anthranilic acid methyl ester, acetophenone, benzyl acetone, benzaldehyde, benzoic acid ethyl ester, benzophenone, benzyl alcohol, borneol, bornyl acetate, α-bromostyrene, n-decylaldehyde, n-dodecylaldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl β-naphthyl ketone, methyl-n-nonylacetaldehyde, methyl n-nonyl ketone, muscone, β-naphthol ethyl ether, β-naphthol methyl ether, nerol, nitrobenzene, n-nonylaldehyde, nonyl alcohol, n-octylaldehyde, p-oxyacetophenone, pentadecanolide, beta-phenylethyl alcohol, phenylacetaldehyde dimethyl acetal, phenylacetic acid, pulegone, safrole, salicylic acid isoamyl ester, salicylic acid methyl ester, salicylic acid hexyl ester, salicylic acid cyclohexyl ester, santalol, skatole, terpineol, delta-terpineol, thymene, thymol, γ-undelactone, vanillin, veratrumaldehyde, cinnamaldehyde, cinnamyl alcohol, cinnamic acid, cinnamic acid ethyl ester, cinnamic acid benzyl ester.

Included among the more-volatile fragrances that are advantageously usable in the perfume oils in the context of the present invention are, in particular, the lower-boiling fragrances of natural or synthetic origin, which can be used alone or in mixtures. Examples of more-volatile fragrances are alkyl isothiocyanates (alkyl mustard oils), butanedione, limonene, linalool, linalyl acetate and linalyl propionate, menthol, menthone, methyl-n-heptenone, phellandrene, phenylacetaldehyde, terpinyl acetate, citral, citronellal.

It has been found that thanks to the use of perfume, in particular perfume oils, in the fluids delivered by the pump according to the present invention, the smoothness of the pump can be further increased and both wear and energy consumption can be further reduced.

Antimicrobial Active Agents

Disinfection and sanitation represent a particular form of cleaning. In a corresponding particular embodiment of the invention, the fluid therefore contains one or more antimicrobial active agents, preferably in a quantity of up to about 40 wt %, preferably about 0.01 to about 25 wt %, in particular about 0.1 to about 5 wt %.

The terms "disinfection," "sanitation," "antimicrobial action," and "antimicrobial active agent" have the technical meaning usual in the context of the teaching of the present invention. While "disinfection" in the narrower sense of medical practice signifies the destruction of (theoretically, all) infective microbes, "sanitation" is to be understood as the greatest possible elimination of all microbes, including the saprophytic ones normally harmless to humans. The degree of disinfection or sanitation depends on the antimicrobial action of the agent utilized, which decreases with a decreasing concentration of antimicrobial active agent or with increasing dilution of the agent to be used.

Antimicrobial active agents suitable according to the present invention are, for example, those from the groups of alcohols, aldehydes, antimicrobial acids or salts thereof, carboxylic acid esters, acid amides, phenols, phenol derivatives, diphenyls, diphenylalkanes, urea derivatives, oxygen and nitrogen acetals and oxygen and nitrogen formals, benzamidines, isothiazoles and derivatives thereof such as isothiazolines and isothiazolinones, phthalimide derivatives, pyridine derivatives, antimicrobial surface-active compounds, guanidines, antimicrobial amphoteric compounds, quinolines, 1,2-dibromo-1,4-dicyanobutane, iodo-2-propynyl butylcarbamate, iodine, iodophores, compounds that release active chlorine, and peroxides. Preferred antimicrobial active agents are preferably selected from the group comprising 1,3-butanediol, phenoxyethanol, 1,2-propylene glycol, glycerol, undecylenic acid, citric acid, lactic acid, benzoic acid, salicylic acid, thymol, 2-benzyl-4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl)urea, N,N'-(1,10-decanediyldi-1-pyridinyl-4-ylidene)-bis-(1-octanamine) dihydrochloride, N,N'-bis-(4-chlorophenyl)-3,12-diimino-2,4,11,13-tetraazatetradecanediimideamide, antimicrobial quaternary surface-active compounds, guanidines, trichloroisocyanuric acid and sodium dichloroisocyanurate (DCI, 1,3-dichloro-5H-1,3,5-triazine-2,4,6-trione sodium salt). Preferred surface-active quaternary compounds having antimicrobial activity contain an ammonium, sulfonium, phosphonium, iodonium, or arsonium group. Antimicrobially effective essential oils, which at the same time provide scenting of the cleaning agent, can also be used. Particularly preferred antimicrobial active agents are selected, however, from the group comprising salicylic acid, quaternary surfactants, in particular benzalkonium chloride, peroxo compounds, in particular sodium percarbonate or phthalimidoperoxyhexanoic acid, alkali metal hypochlorite, trichloroisocyanuric acid, sodium dichloroisocyanurate, and mixtures thereof.

The use of an antimicrobial active agent in the fluid delivered by the pump is advantageous in that upon an extended stoppage of the pump, microbial deposition on the pump surfaces is prevented and no frictional losses or clogs therefore are therefore to be expected.

Bleaching Agents

According to the present invention, bleaching agents can be added to the fluid. Suitable bleaching agents comprise peroxides, peracids, and/or perborates; sodium percarbonate or phthalimidoperoxyhexanoic acid is particularly preferred. Chlorine-containing bleaching agents such as trichloroisocyanuric acid or sodium dichloroisocyanurate, on the other hand, are less suitable for acid-formulated cleaning agents due to the release of toxic chlorine gas vapors, but can be used in cleaning agents adjusted to be alkaline. In some circumstances a bleach activator can also be necessary alongside the bleaching agent.

Corrosion inhibitors Suitable corrosion inhibitors (NCI: Corrosion Inhibitors) are, for example, the following substances recited in accordance with INCI: Cyclohexylamine, Diammonium Phosphate, Dilithium Oxalate, Dimethylamino Methylpropanol, Dipotassium Oxalate, Dipotassium Phosphate, Disodium Phosphate, Disodium Pyrophosphate, Disodium Tetrapropenyl Succinate, Hexoxyethyl Diethylammonium, Phosphate, Nitromethane, Potassium Silicate, Sodium Aluminate, Sodium Hexametaphosphate, Sodium Metasilicate, Sodium Molybdate, Sodium Nitrite, Sodium Oxalate, Sodium Silicate, Stearamidopropyl Dimethicone, Tetrapotassium Pyrophosphate, Tetrasodium Pyrophosphate, Triisopropanolamine.

Enzymes

The fluid can also contain enzymes, preferably proteases, lipases, amylases, hydrolases, and/or cellulases. They can be added to the agent according to the present invention in any form established in the existing art. This includes solutions of the enzymes, advantageously maximally concentrated, low in water, and/or with stabilizers added. Alternatively, the enzymes can be encapsulated, for example by spray drying or extrusion of the enzyme solution together with a (preferably natural) polymer or in the form of capsules, for example those in which the enzymes are enclosed as if in a solidified gel or in those of the core-shell type, in which an enzyme-containing core is coated with a protective layer that is impermeable to water, air, and/or chemicals. Further active agents, for example stabilizers, emulsifier agents, pigments, bleaches, or dyes, can additionally be applied in superimposed layers. Such capsules are applied using methods known per se, for example by vibratory or roll granulation or in fluidized bed processes. Advantageously, such granulates are low in dust, for example thanks to the application of polymeric film formers, and are shelf-stable as a result of the coating. Enzyme stabilizers can furthermore be present in enzyme-containing agents in order to protect an enzyme contained in a fluid from damage such as, for example, inactivation, denaturing, or decomposition, for example as a result of physical influences, oxidation, or proteolytic cleavage. The following are particularly suitable as enzyme stabilizers, depending in each case on the enzyme being used: benzamidine hydrochloride, borax, boric acids, boronic acids or salts or esters thereof, principally derivatives having aromatic groups, e.g. substituted phenylboronic acids or salts or esters thereof; peptide aldehydes (oligopeptides having a reduced carbon terminus), aminoalcohols such as mono-, di-, triethanol- and -propanolamine and mixtures thereof, aliphatic carboxylic acids up to $C_{12}$ such as succinic acid, other dicarboxylic acids or salts of the aforesaid acids; end-capped fatty acid amide alkoxylates; lower aliphatic alcohols and especially polyols, for example glycerol, ethylene glycol, propylene glycol, or sorbitol; as well as reducing agents and antioxidants such as sodium sulfite and reducing sugars. Further suitable stabilizers are known from the existing art. It is preferred to use combinations of stabilizers, for example the combination of polyols, boric acid, and/or borax, the combination of boric acid or borate, reducing salts, and succinic acid or other dicarboxylic acids, or the combination of boric acid or borate with polyols or polyamino compounds and with reducing salts.

The use of a pump described here in a fluid discharging system is particularly advantageous for a number of reasons. Firstly, the pump can withdraw fluid from a container with negative pressure, in other words it can create a partial volume, with the result that the fluid contained in the container can be drawn out without replacing the volume of discharged fluid that emerges from the container with ambient air. The quantity of fluid discharged depends only on the number of revolutions executed by the rotor of the pump, and not on the pressure difference between the fluid container and the ambient pressure, and also not on the flow resistance of discharged fluid in the pump or the outlet nozzle. The discharging system according to this invention can spray very small quantities of fluid, in precisely controlled and very uniformly distributed fashion, around and radially outward from the spray head. The pump used in the context of the present invention also enables accurate metering of the discharged fluid and makes valves superfluous, since the pump itself contains a valve function.

The pump is suitable in particular for being provided to spray fluids having a cleaning and/or scenting function. For example, the pump can be a constituent of a toilet cleaning system in which the spray stream of the fluid covers the entire inner region of a toilet bowl. It is furthermore conceivable to provide the pump according to the present invention for metering fluids in automatic dishwashing and/or washing machines.

What is claimed is:

1. A fluid discharging system comprising a pump and a discharge spray head comprising at least one nozzle, through which the fluid to be discharged emerges, the pump comprising a stator and a rotor that is mounted in a chamber of the stator and is rotatable with respect to the stator around a rotation axis and is axially displaceable along the axis, wherein the axial displacement of the rotor in a first axial direction is configured so that it brings about a pump filling function in which a fluid is drawn through an inlet into the stator chamber, and in an opposite, a second axial direction is configured so that it brings about a discharge function in which the fluid in the chamber is expelled from an outlet of the pump, wherein the outlet of the pump is arranged in the rotor and the discharge spray head is connected fluidically to the outlet of the pump and is arranged at or adjacently to an axial outlet end of the rotor, wherein the discharge spray head is configured so that it discharges the fluid at least in part in a radial direction surrounding the rotation axis, wherein the fluid comprises at least one surfactant, wherein the rotor comprises a first and a second axial extension of different diameters that are mounted in corresponding first and second chamber segments of the stator chamber, and first and second seals that are mounted in the stator housing and sealingly surround the first and the second axial rotor extension, wherein the rotor extensions comprise fluid delivery conduits that, in combination with the respective sealing rings, serve as valves that open and close a connection respectively between the inlet of the pump and the chamber segments, and between the chamber segments and the outlet of the pump, as a function of the angular displacement of the pump rotor.

2. The discharging system according to claim 1, wherein the outlet of the pump is arranged in a second axial rotor extension, and the second axial rotor extension has a diameter that is smaller than the diameter of the first axial rotor extension.

3. The discharging system according to claim 1, wherein the outlet of the pump defines an aperture at an axial emergence end of the rotor.

4. The discharging system according to claim 1, wherein the discharge spray head is mounted immovably at the axial outlet end of the rotor, or extends therefrom and rotates together with the rotor.

5. The discharging system according to claim 1, wherein the discharge spray head is mounted in the form of a separate component at the axial emergence end of the rotor.

6. The discharging system according to claim 4, wherein the discharge spray head has a diameter that is greater than the diameter of the axial emergence end of the rotor.

7. The discharging system according to claim 1, wherein the discharge spray head comprises a plurality of nozzles that are oriented at one or more angles ($\alpha$) with respect to the radial direction (R), wherein $-80° < \alpha < +90$.

8. The discharging system according to claim 7, wherein specific nozzles of the plurality of nozzles are oriented at different angles with respect to the radial direction.

9. The discharging system according to claim 1, wherein the axial emergence end of the rotor extends outside the stator.

10. The discharging system according to claim 1, wherein a rotation angle of the pump discharge mode is in the range from about 60° to about 120°.

11. The discharging system according to claim 10, wherein the rotation angle of the pump discharge mode is approximately 90°.

12. The discharging system according to claim 10, wherein the discharge spray head is mounted fixedly on an end wall of a housing of the stator, adjacently to the outlet end of the rotor arranged in the housing.

13. The discharging system according to claim 1, wherein the rotor and the stator comprise complementary cam mechanisms that define the axial displacement of the rotor in opposite axial directions as a function of the angular displacement of the rotor.

14. The discharging according to claim 1, wherein the fluid comprises one or more scents.

15. The discharging system according to claim 1, wherein the fluid contains one or more antimicrobial active agents.

16. The discharging system according to claim 1, wherein the surfactant is present in the fluid in an amount of about 0.1 to about 30 weight % based on the total weight of the fluid.

* * * * *